US012228060B2

(12) United States Patent
Van Den Heuvel et al.

(10) Patent No.: US 12,228,060 B2
(45) Date of Patent: Feb. 18, 2025

(54) HEATER CONTROL FOR AN AFTER TREATMENT SYSTEM

(71) Applicant: DAF Trucks N.V., Eindhoven (NL)

(72) Inventors: Ignace Theodorus Maria Van Den Heuvel, Eindhoven (NL); Tim Weidema, Hoef en Haag (NL)

(73) Assignee: DAF Trucks N.V., Eindhoven (NL)

( * ) Notice: Subject to any disclaimer, the term of this patent is extended or adjusted under 35 U.S.C. 154(b) by 0 days.

(21) Appl. No.: 18/368,241

(22) Filed: Sep. 14, 2023

(65) Prior Publication Data

US 2024/0110495 A1 Apr. 4, 2024

(30) Foreign Application Priority Data

Sep. 26, 2022 (NL) ..... 2033137

(51) Int. Cl.
*F01N 3/20* (2006.01)
*F01N 3/10* (2006.01)

(52) U.S. Cl.
CPC ..... *F01N 3/2006* (2013.01); *F01N 3/10* (2013.01)

(58) Field of Classification Search
CPC .. F01N 2240/16; F01N 2560/06; F01N 3/027; F01N 3/2013
See application file for complete search history.

(56) References Cited

U.S. PATENT DOCUMENTS 5,444,976 A * 8/1995 Gonze ..... F01N 3/2013 60/284
5,904,902 A * 5/1999 Matuoka ..... F01N 3/2013 422/174
9,334,843 B2 * 5/2016 Czimmek ..... F02M 53/06
11,925,214 B2 * 3/2024 Lee ..... A24F 40/42
2008/0307774 A1 * 12/2008 Gonze ..... F01N 3/2013 60/303
2012/0023908 A1 * 2/2012 Klenk ..... F02D 41/1438 60/277

(Continued)

FOREIGN PATENT DOCUMENTS

CN 110206624 A 9/2019
DE 102008039585 A1 6/2009

OTHER PUBLICATIONS

Dutch Search Report and Written Opinion—App No. 2033137—mailing date Apr. 25, 2023.

*Primary Examiner* — Anthony Ayala Delgado
(74) *Attorney, Agent, or Firm* — Banner & Witcoff, Ltd.

(57) ABSTRACT

A control system is arranged to control the heater system; wherein the control system is programmed to heat the exhaust after treatment system based on a setpoint value. The control system comprises a controller having an error input and an output; that outputs a heating power setpoint value that is adjusted by a feedback signal, said adjusted setpoint value provided in parallel to a branch including the heater system and a branch including a dynamic response system. The dynamic response system comprises a dynamic response part and a delay part. A first subtractor subtracts a measured heat output and an output of the dynamic response system; an adder adds an output of the dynamic response part and an output of the first subtractor. A second subtractor subtracts a heating power setpoint from the output of the adder to provide a control error signal for the error input of the controller.

14 Claims, 7 Drawing Sheets

(56) References Cited

U.S. PATENT DOCUMENTS

Figure 1:
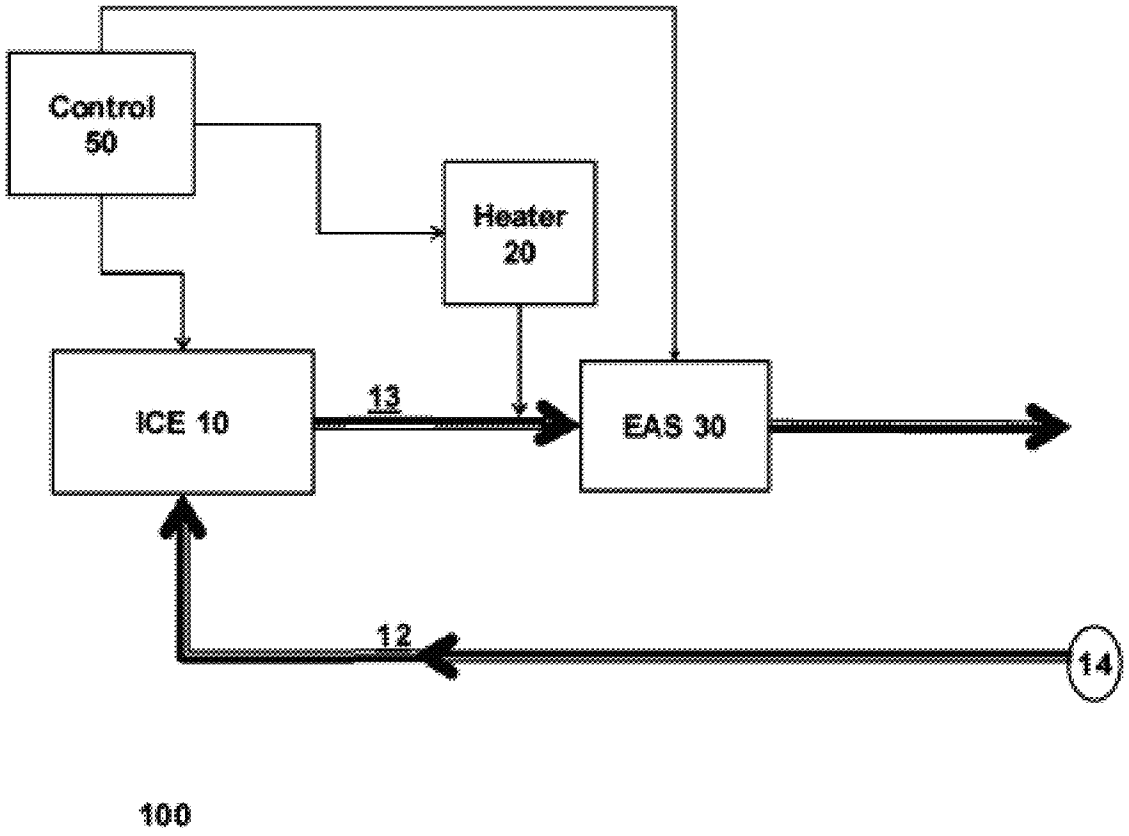

| | | | | |
|---|---|---|---|---|
| 2014/0182272 | A1* | 7/2014 | Czimmek | F01N 3/2013 60/277 |
| 2024/0068103 | A1* | 2/2024 | Lu | C23C 16/52 |
| 2024/0072716 | A1* | 2/2024 | Imandi | H02K 11/25 |

* cited by examiner

HEATER CONTROL FOR AN AFTER TREATMENT SYSTEM

CROSS-REFERENCE TO RELATED APPLICATIONS

This application claims priority under 35 U.S.C. § 119 to Application NL 2033137, filed Sep. 26, 2022, which is hereby incorporated by reference in its entirety.

BACKGROUND

In modern day diesel engines, measures are taken to minimize fuel consumption and harmful emissions. The emissions of diesel soot and NOx can be reduced in an engine aftertreatment system (EAS). Typical components of such an aftertreatment system may be a diesel particulate filter to capture soot, and a catalytic converter more specifically an SCR (Selective Catalytic Reduction) catalyst that converts NOx into harmless products also known as the deNOx process and a diesel oxidation catalyst (DOC) to (inter alia) increase the deNOX efficiency and oxydize unburned hydrocarbon and CO. In normal operation, the aftertreatment system can be heated by residual heat from the combustion engine, however, at very low loads, the temperature of the exhaust gas may be too low. The temperature may be influenced by an engine efficiency mode, which controls the efficiency of the engine and an engine out temperature. For high efficiency engine power settings, the temperature may be too low to accommodate a required NOx conversion efficiency of the catalytic converter, in which case the engine aftertreatment system temperature should be increased to provide a better performance of the SCR system.

A possible method to meet these new regulations is to (locally) release heat in a component of the exhaust after treatment system, by applying a thermal measure, and thereby increasing the temperature of the downstream SCR system. To this end aftertreatment systems may further include a heater system, which may include: an electrical heater; a fuel burner, but may also include engine measures or a combination of these. Typically, the reactivity of aftertreatment systems increases when temperature of the catalyst material and the exhaust gas increases at least up to a certain temperature. In order to quickly reach a high conversion efficiency of the aftertreatment system after engine start, the heater system may be used to heat the aftertreatment system to an operating temperature, which may be around 200-300° C. The control objective for the thermal management strategy is to maintain the SCR temperature robustly on the SCR light-off temperature. Applying insufficient heat could lead to loss of deNOx performance and applying too much heat will lead to an increase of the fuel consumption, leading to a CO2 penalty for increasing the aftertreatment temperature when a higher temperature is not necessary. A robust controller with good tracking behaviour allows for lowering the target temperature closer to the SCR light-off temperature and thus lower the fuel penalty associated with thermal management.

A problem with the control of this type of system is the long lead times between applying heat via the thermal measure and to have an effect downstream of the system, due to the long lead times (deadtime) and the large thermal inertia.

It is an object of this invention to more efficiently control the heater system, while at the same time generate an amount of enthalpy necessary for a sufficient SCR conversion.

SUMMARY

It is an aspect of the present invention to alleviate, at least partially, the problems discussed above. It is aimed to provide an internal combustion engine comprising a heater system to generate heat to the exhaust aftertreatment system including a catalytic converter. A control system is arranged to control the heater system; wherein the control system is programmed to heat the exhaust after treatment system based on a setpoint value. The control system comprises a controller having an error input and an output; that outputs a heating power setpoint value that is adjusted by a feedback signal, said adjusted setpoint value provided in parallel to a branch including the heater system and a branch including a dynamic response system. The dynamic response system comprises a dynamic response part and a delay part. A first subtractor subtracts a measured heat output and an output of the dynamic response system; an adder adds an output of the dynamic response part and an output of the first subtractor. A second subtractor subtracts a heating power setpoint from the output of the adder to provide a control error signal for the error input of the controller.

It is noted that conventional PID control will face stability issues if the phase delay of the system is close to the systems deadtime. This can be solved by adding phase margin (conservative calibration), but this comes at the cost of performance (heat-up time).

By providing the added output of the dynamic response part and the output of the first subtractor, a faster response can be obtained, without a need for a large phase delay to prevent stability problems of the controller.

The specific position of the heater system may be dependent on practical conditions. It may be a system that can be integral to the aftertreatment system.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 2:
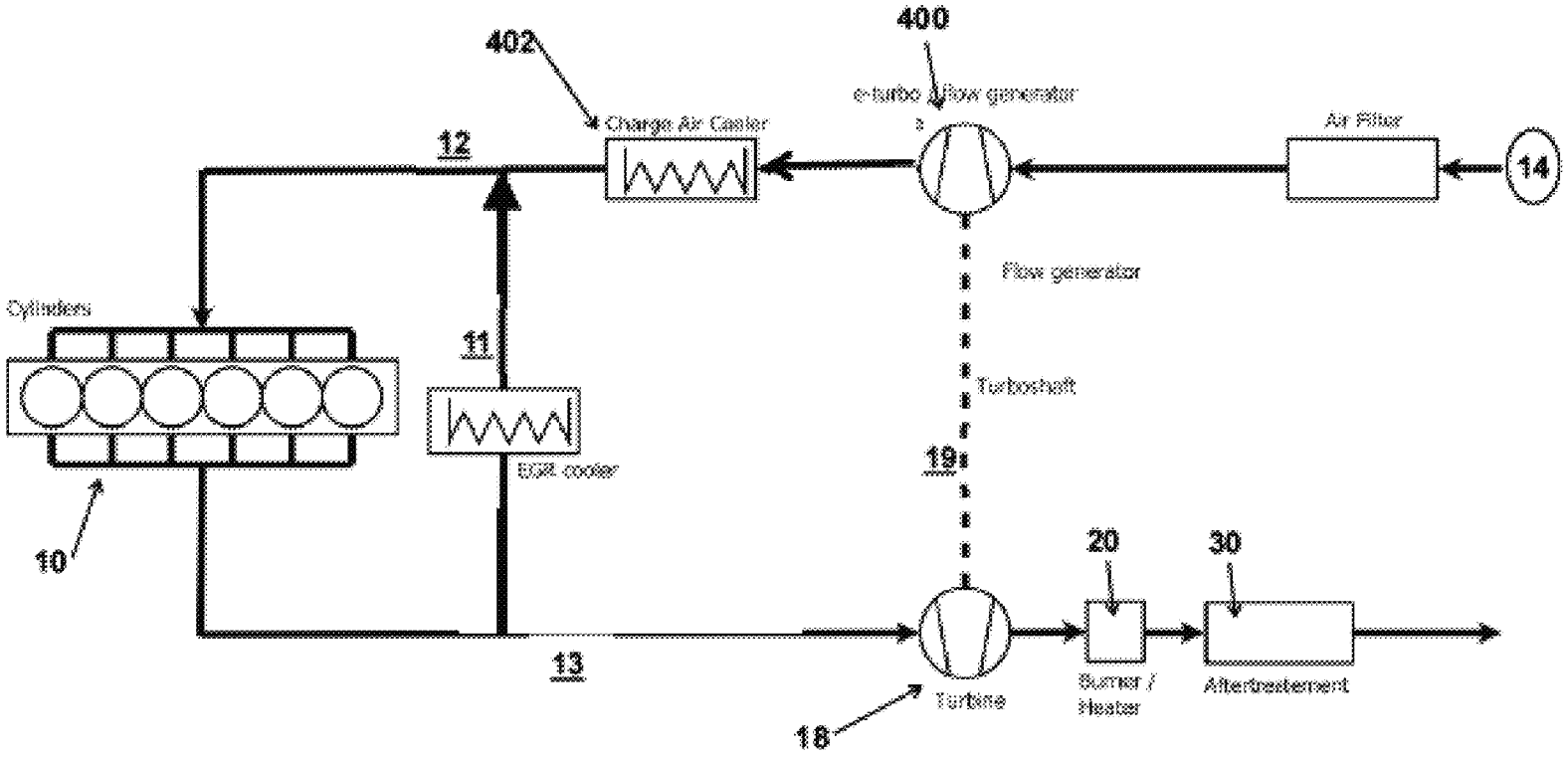
Figure 3:
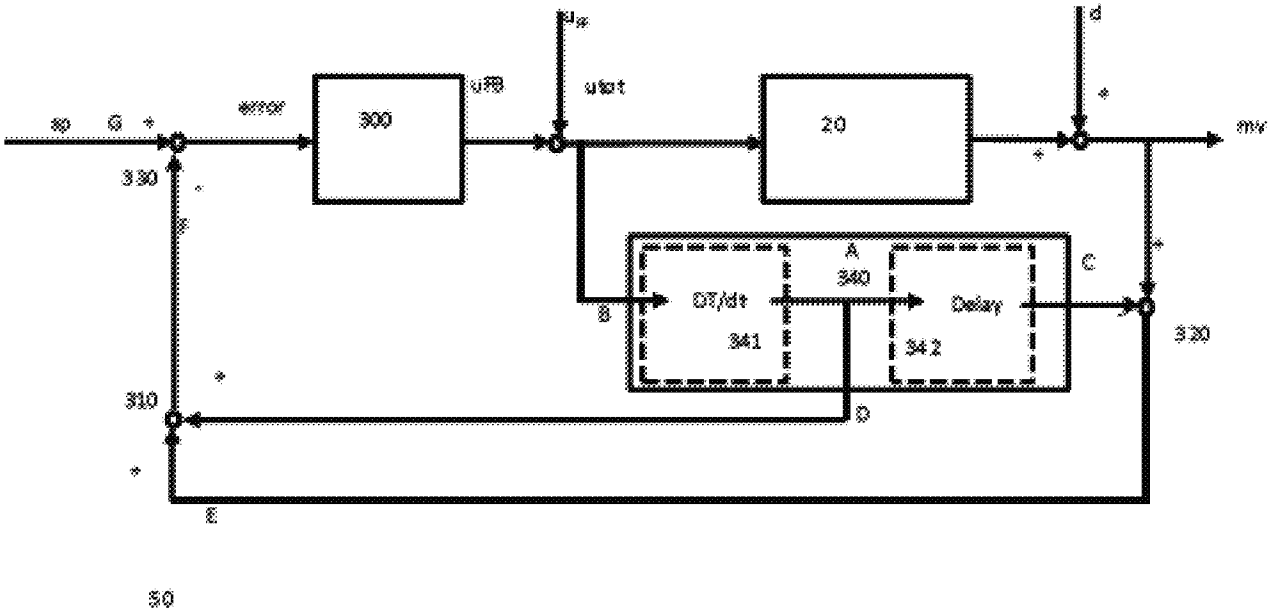
Figure 4A:
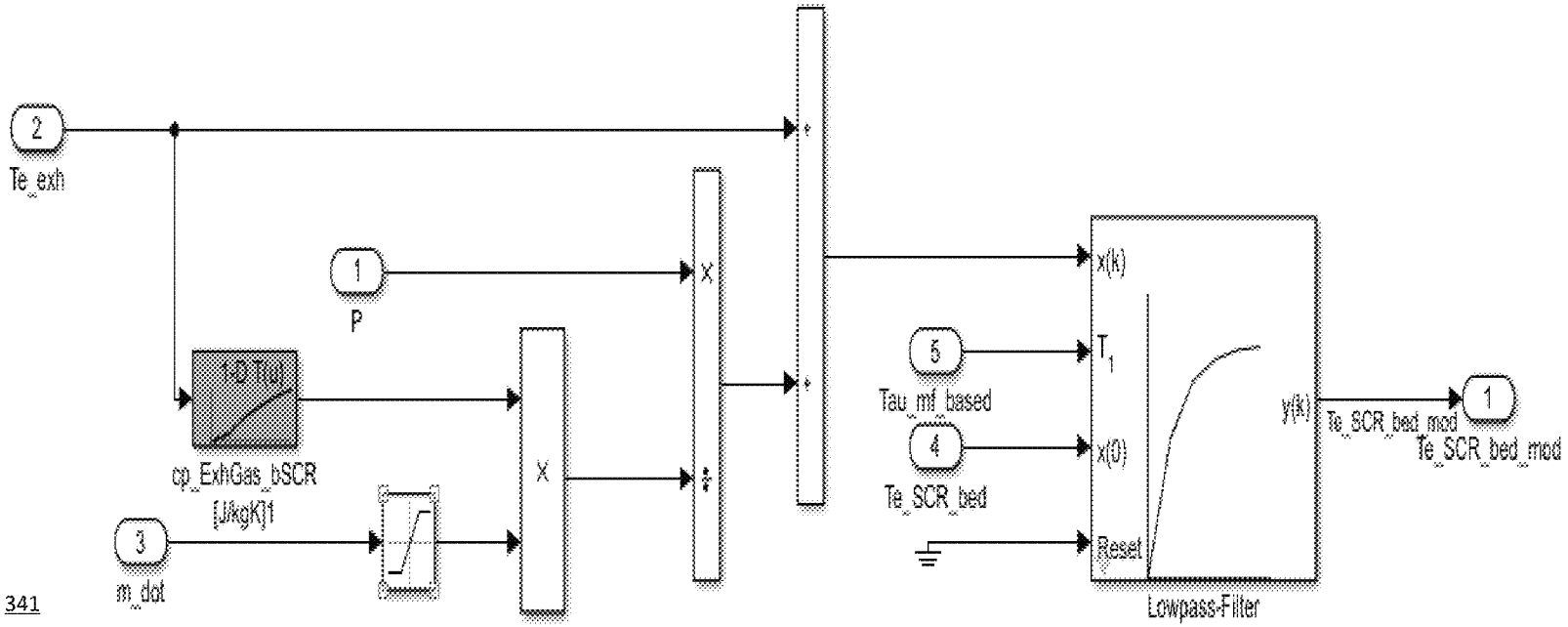
Figure 5:
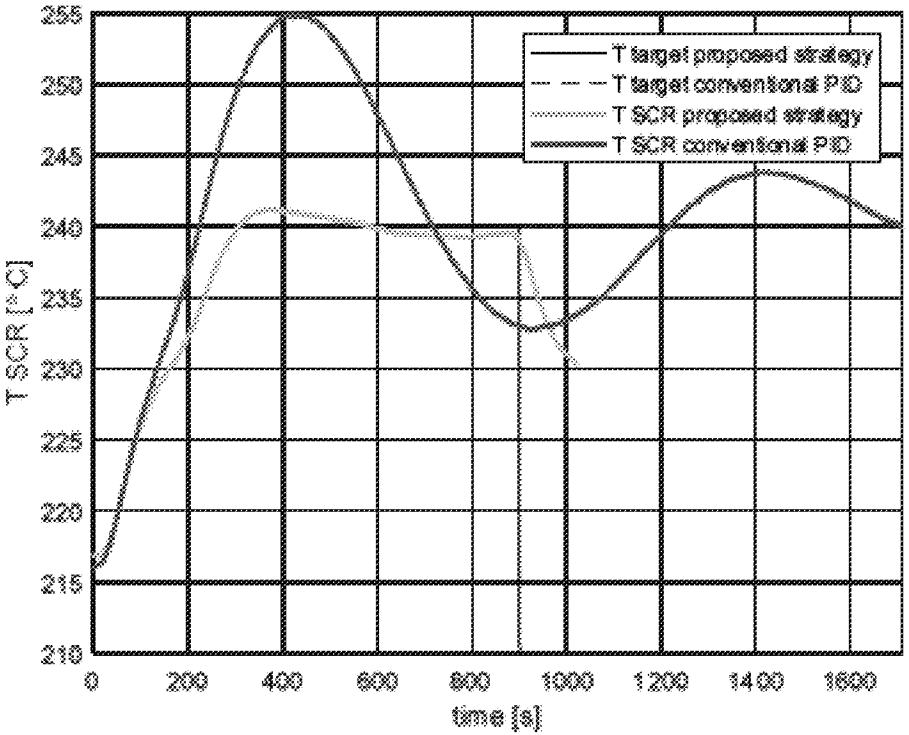

FIG. 1 shows a simplified schematic representation of a system setup of an internal combustion engine;

FIG. 2 an shows an embodiment with a conventional turbo compressor arrangement;

FIG. 3 further exemplifies control system shown in FIG. 2;

FIGS. 4A; B and C show a model representation that is a further implementation of the system diagram of FIG. 3; and FIG. 5 shows a temperature diagram of the SCR heater.

DETAILED DESCRIPTION

Unless otherwise defined, all terms (including technical and scientific terms) used herein have the same meaning as commonly understood by one of ordinary skill in the art to which this invention belongs as read in the context of the description and drawings. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In some instances, detailed descriptions of well-known devices and methods may be omitted so as not to obscure the description of the present systems and methods. The term "and/or" includes any and all combinations of one or more of the associated listed items. It will be further understood that the terms "comprises" and/or "comprising" specify the presence of stated features but do not preclude the presence or addition of one or more other features. All publications, patent applications, patents, and other references mentioned herein are incorporated by reference in their entirety. In case of conflict, the present specification, including definitions, will control.

FIG. 1 shows a simplified schematic representation of a system setup 100 of an internal combustion engine (ICE 10) and a typical aftertreatment system (EAS 30). The EAS system may comprise a hydrocarbon (HC) dosing unit, a Diesel Oxidation Catalyst (DOC), a Diesel Particulate Filter (DPF), a Urea dosing unit, a Selective Catalytic Reduction catalyst (SCR), an Ammonia Slip Catalyst (ASC) and a Control Module (CM) placed downstream in the exhaust line 13 of the ICE 10 typically including a turbo compressor. This setup is conventional, in the sense that the system elements are known to the skilled person. EAS control 50 in FIG. 1 can be provided on the basis of NOx sensor data or a model. This means that this sensor is used indicatively for the control of NOx out of the system, and therefore for the dosing of DEF fluid, which implies the functioning of part of the EAS. In addition, in addition to a NOx sensor, other sensors may be used, for example flow sensors, chemical substance sensors, etc., that can indicate whether the aftertreatment system is affected by degradation. Internal combustion engine (ICE 10) comprises an exhaust line 13 configured to receive exhaust gas from the internal combustion engine 10 and an intake line 12 configured to supply pressurized air from an air intake 14 to the internal combustion engine 10. A heater system 20 may be disposed in or adjacent the exhaust line 13 to generate heat that is transported via the exhaust line 13 to an exhaust aftertreatment system (EAS) 30. Alternatively, heat can be provided by thermal measures to increase the engine heat production. A control system 50 is arranged to control the heater system 20 to transport heat generated by the heater system 20 towards EAS 30.

During cold start or in other conditions where the operating temperature of the EAS 30 is insufficient, the heater system 20 may also be activated.

Heater system 20 may be an electric heater system or it may be a burner or other heat source. A turbo can be controlled to achieve certain boost pressure for the engine intake line 12 and may be a turbo compressor of a known type, where mechanical energy derived from the exhaust turbine may be electrically boosted by an electric motor. The compressor may also be all-electric or may be hybrid—that is, the compressor can be mechanically driven by the turbine and at the same time boosted by an electric motor.

The control system 50 may calculate the heat addition delivered by the heater system/burner. This can be determined by a temperature sensor or a model, in view of the exhaust gas flow, that is provided by the heater system 20.

Turning to FIG. 2 an internal combustion engine 10 is illustrated with a conventional turbo compressor arrangement, i.e. a turbine 18 arranged in the exhaust line 13, that is mechanically coupled to a compressor 400 via a turbo shaft 19. In this example, the compressor can be of a conventional type. The compressor 400 boosts the pressure, via a charge air cooler 402 into the engine 10. If the control system detects that the EAS 30 is in need for additional heating, heater system, e.g. diesel burner 20 is activated, to generate a catalytic converter temperature to a calculated set target temperature of the catalytic converter. This can be executed by a feed forward control, e.g. implemented in hardware or software in a control system, geared to a standard acceptable flow provided to the heater system 20 that allows the heater system to heat at its maximum heater system capacity. It can also in a feedback loop control, e.g. by a flow-controlled process, that increases the fuel in dependence of increased flow in the exhaust line 13 or by a temperature-controlled process, that increases the flow in dependence of a measured or calculated threshold temperature of the heater system 20 adjacent the exhaust line 13. Since heat transfer is most efficient at high temperatures, this latter option is a preferred mode.

The internal combustion engine 10 may comprise an exhaust gas recirculation (egr) line 11 for use, in egr mode, to supply exhaust gas to the intake line 12.

FIG. 3 further exemplifies control system 50 (see FIG. 1) for selective control of the heater system 20 for generating heat generated by the heater system towards the aftertreatment system—to this end the control system is programmed to heat the exhaust after treatment system based on a setpoint value representing a feedforward control (uFF), with an initial compensation for lead times and large thermal inertia. In addition to the feed forward control, a feedback controller is provided, so that a heating power setpoint value that is adjusted by a feedback signal ($u_{FB}$). It is noted that the system is suitable for powering an electric heater, but can also be applied to other heater systems.

A dynamic response system (A) capturing theses long lead times and the large thermal inertia is added to the feedback controller (FIG. 5). The dynamic response system is split up in a part 341 which describes the dynamic response with the thermal inertia (dT/dt) and another part 342 which captures the lead time (Delay).

The adjusted setpoint value of the controller actuation ($u_{FF}+u_{FB}=u_{tot}$) will be fed to the actual electrical heater, but also will be used to feed (B) the simple model, i.e. said adjusted setpoint value provided in parallel to a branch including the heater system 20 and a branch including a dynamic response system A.

The temperature measured—representing the SCR system (mv)—is not directly compared to the target setpoint for the temperature (sp or G) (as in a normal arrangement), but the target setpoint (sp or G) is in part compared to a modelled temperature (D) according to the dynamic response part 341. To this end adder 310 adds an output of the dynamic response part 341 and an output of the first subtractor 320, which subtracts a measured temperature of the SCR system (mv) and an output (C) of the dynamic response system 340—see further below. Thus, output D is a result of how the control action ($u_{tot}$) forces the dynamic response part 341 to react to controller actuation without including a delay, which corresponds to an actual predicted response of the SCR system.

As mentioned already, the modelled temperature result of 341 is also used to estimate what the system would do if the dead time was actually taken into account, by delay part 342. This results in output C that is provided to first subtractor 320. The output C will accordingly be compared the actual behaviour of the system (mv), and then this results in (E), which can be described as a predicted error. A second subtractor 330 subtracts heating power setpoint (sp) from the output of the adder 310 to provide a control error signal for the error input of the controller 300.

This predicted error (E) will be added to the predicted (undelayed) estimation of the system (D). Together (F) this will be used to compare against the desired temperature target (G) and finally (error) used to feed into the controller 300.

The effect of applying dynamic response system 340 in the feedback will result in that the large lead time is effectively cancelled out with the (E) and (D) loops, and thereby speeding up the control loop. The best results are obtained when the simple model matches exactly the dynamic of SCR system, reality is that this will not happen, but still there is enough improvements to speed up the control loop.

FIGS. 4A; B and C show a model representation that is a further implementation of the system diagram of FIG. 3. FIG. 4A shows a representation of the dynamic response part 341 that is set-up to calculate the EAS temperatures in steady state conditions. In this example, the dynamic response system calculates a catalytic converter temperature as a sum of combustion engine out temperature and an added heat power term P compensated by heat loss:

$$T_{SCR\,SS} = T_{ICE\,out} + \frac{P_{TM} - P_{loss}}{m'_{exh} \cdot c_p(T_{ICE\,out})}$$

Where:

$T_{SCRSS}$=Steady state SCR temperature $T_{ICE\ out}$=Engine exhaust gas temperature $P_{TM}$=Power added to the exhaust gas by a thermal measure $P_{loss}$=Calculated power losses over the aftertreatment system $m'_{exh}$=Exhaust gas massflow $c_p(T_{ICE\ out})$=Specific heat of exhaust gas at constant pressure, determined for $T_{ICE\ out}$ $P_{loss}$ may be calculated by solving the convective heat transfer equation per EAS component or be a calibratable loss as a function of $m'_{exh}$ and $T_{ICE\ out}$ with a vehicle speed and ambient temperature dependency.

In the ideal situation that everything is perfectly known and stable, then $P_{TM}$ can be set equally to $P_{loss}$, which in terms of control represents that the feedforward term $u_{FF}$ is $P_{TM}$. The added heat power may be provided by the heater system to be controlled.

The heat loss may be calculated as a sum of heat losses over exchange surfaces of the exhaust after treatment system, with ambient temperature.

In detail, the convective heat losses are calculated by:

$$P_{loss} = \sum_{i=1}^{i=n} P_{loss\,component\,i}$$

$$P_{loss\,component\,i} = A_i \cdot h_i(T_i - T_{amb})$$

Where:

$P_{loss\ componenti}$=Power loss of the $i^{th}$ aftertreatment component n=total number of evaluated aftertreatment components $A_i$=Outer surface area of $i^{th}$ aftertreatment component $h_i$=heat transfer coefficient $i^{th}$ aftertreatment component $T_i$=The surface temperature of the $i^{th}$ aftertreatment component $T_{amb}$=The ambient temperature The heat loss may calculate with a transfer coefficient that is dependent on vehicle speed. The heat transfer coefficient can be dependent on the local wind speed and on the geometric shape. Assuming the aftertreatment is a flat surface, the heat transfer coefficient is given by:

$$h_i = 6.2 + 4.2 \cdot v_{veh} \cdot k_i$$

Where:

$v_{veh}$=Vehicle speed $k_i$=Wind speed fraction of the vehicle speed at the $i^{th}$ component The output of the dynamic response part, corresponding to a calculated SCR temperature, is an undelayed response that is low pass filtered with a massflow dependent variable time constant. The time constant is a function of the exhaust massflow and is tuned to resemble the thermal inertia of the system (A1). This output of the model component (A) resembles signal (D) of the figure, and it is the undelayed description of the behaviour.

$$T_{SCR\ dyn} = \text{lowpass}(T_{SCR\ SS}, \tau(m'_{exh}))$$

Where:

$T_{SCR\ dyn}$=dynamic model value of the SCR temperature lowpass=any type of low pass filter $\tau(m'_{exh})$=variable time constant as a function of exhaust gas massflow In the representation of FIG. 4A, the dynamic response part is provided by a low pass filter and an adder, said adder adding the exhaust temperature Te_exh to an output of a divider, the divider provided with a power term P, to be divided by exhaust mass flow multiplied by a specific heat value cp_ExhGas, dependent on the exhaust temperature; which low pass filter filters the adder output by a mass flow based time constant Tau_mf_based to provide an undelayed response Te_SCR_bed_mod.

Figure 4B:
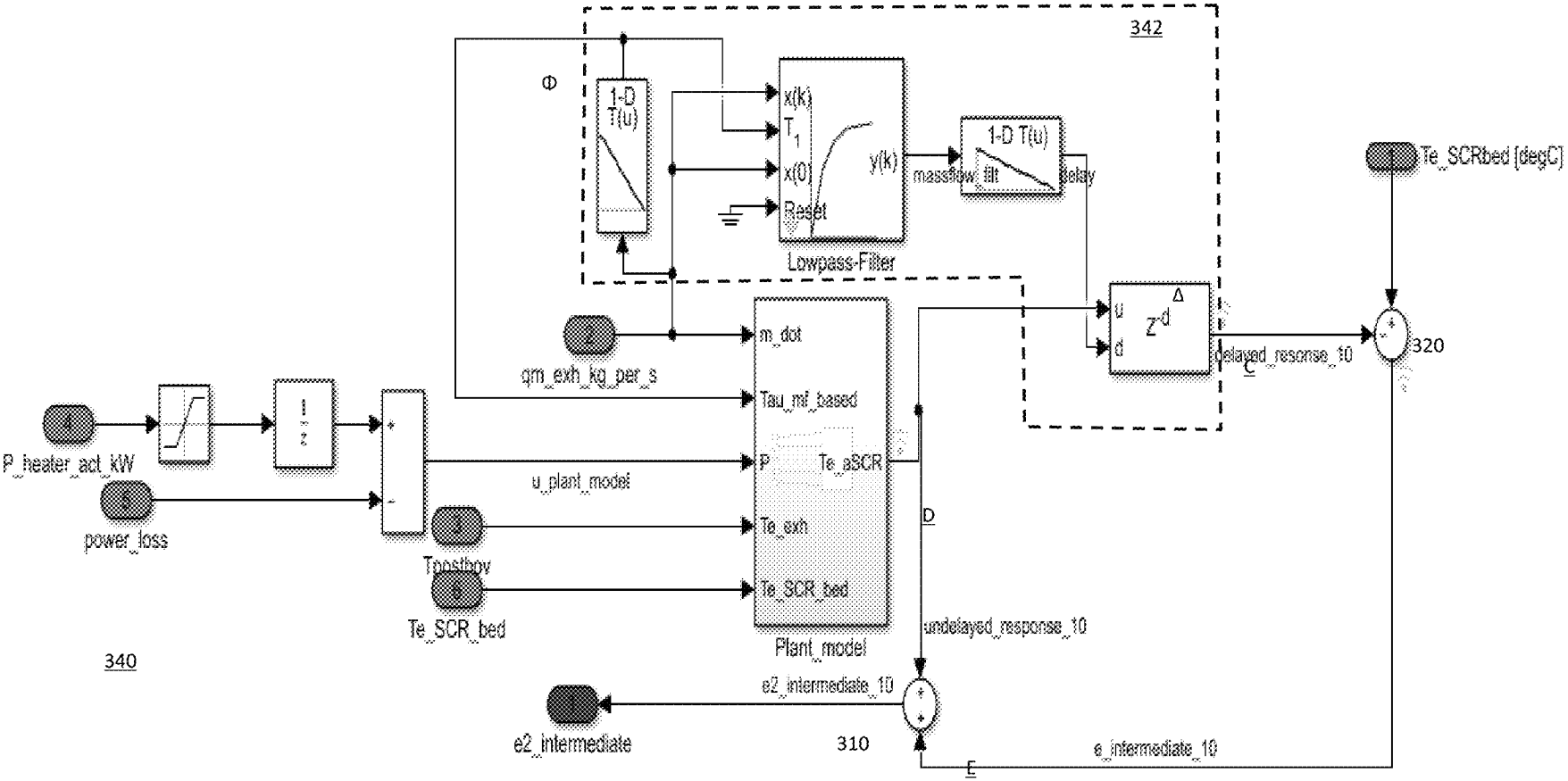

The representation of FIG. 4B concerns the total dynamic response system 340 including a delay part 342. In the Figure: Delayed_resonse_10 (representing C), undelayed_response_10 (representing D), e2_intermediate (representing F). The delay part 342 comprises to this end a variable delay (D) provided with an input u receiving the undelayed response, said variable delay further comprising an input d receiving a massflow dependent time constant, and an output providing a delayed response (delayed_response_10) based on a time constant that is dependent on registered mass flow qm_exh_kg_per_s. First subtractor 320 subtracts a measured temperature of the SCR system (mv) and the delayed response, corresponding to output (C) of the dynamic response system 340. The registered mass flow value is low pass filtered by Φ to prevent sudden changes in mass flow influencing the delay too much. Adder 310 adds output D of the dynamic response part and an output E of the first subtractor 320 to result in an intermediate error e2_intermediate.

Figure 4C:
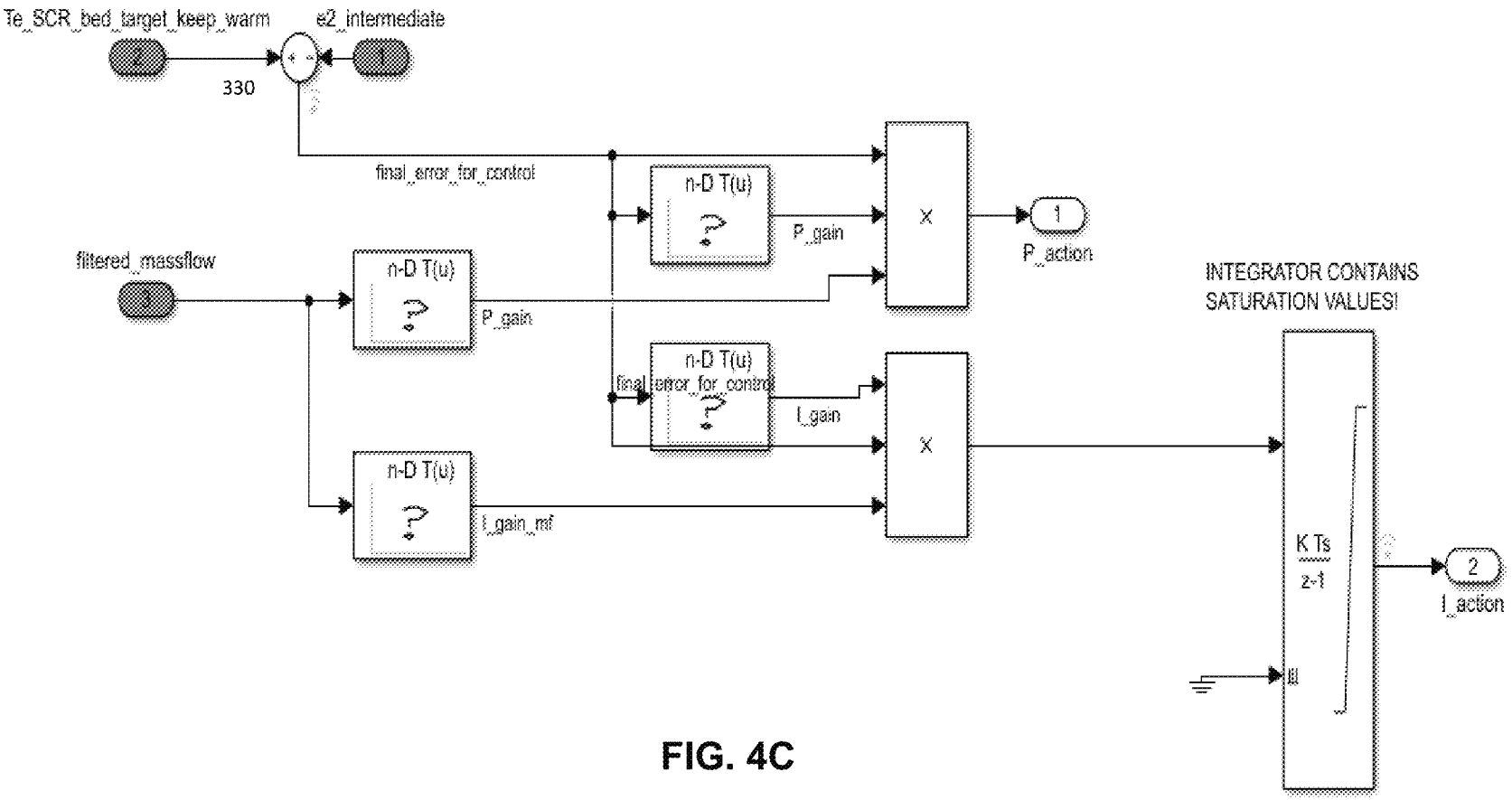

The representation of FIG. 4C concerns an implementation of the control system in a PI controller, receiving the intermediate error e2_intermediate (representing F). Te_SCR_bed_target_keep_warm (representing G), final_error_for_control (representing the error signal error). In the controller a P-action is provided with the control error signal and a calibratable gain from a time-filtered massflow value; and an I-action is provided with the error control signal and a calibratable gain from a time-filtered massflow value; wherein the P-action and I-action are combined to the feedback signal; and wherein a feed forward signal is provided in addition to the feedback signal to result in the adjusted heating power setpoint value.

By way of example, FIG. 5 shows a temperature diagram of the SCR heater that is attained by the heater control. A target is set at 240° Celsius for a period of 900 seconds. The proposed strategy reaches set point in about 300 seconds, and manages to stay on setpoint almost within a temperature range of 5° Celsius. A conventional strategy would have an overshoot of at least 15° Celsius and will then oscillate to lower temperatures, effectively reducing the efficiency of the SCR.

Other variations to the disclosed embodiments can be understood and by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single unit may fulfil the functions of several items recited in the claims. The mere fact that certain measures are recited in mutually different dependent claims does not indicate that a combination of these measured cannot be used to advantage. Any reference signs in the claims should not be construed as limiting the scope.

The invention claimed is:

1. An internal combustion engine comprising:

a heater system to generate heat to an exhaust after treatment system including a catalytic converter;

a control system arranged to control the heater system; wherein the control system is programmed to heat the exhaust after treatment system based on a setpoint value;

wherein the control system comprises a controller having an error input and an output; that outputs an adjusted heating power setpoint value, having been adjusted by a feedback signal, said adjusted heating power setpoint value provided in parallel to a branch including the heater system and a branch including a modelled response circuit;

said modelled response circuit receiving the feedback signal and comprising, in series, a response circuit part outputting a modelled response to said feedback signal, and a delayer circuit part that delays the modelled response;

a first subtractor that subtracts a measured heat output and an output of the modelled response circuit;

an adder that adds an output of the response circuit part and an output of the first subtractor;

a second subtractor that subtracts the adjusted heating power setpoint value from an output of the adder to provide a control error signal for the error input of the controller.

2. The internal combustion engine according to claim 1, wherein the modelled response circuit calculates a catalytic converter temperature as a sum of combustion engine out temperature and an added heat power term compensated by heat loss; and delayed by the delayer circuit part.

3. The internal combustion engine according to claim 2, wherein the added heat power term is provided by the heater system to be controlled.

4. The internal combustion engine according to claim 1, wherein the delayer circuit part calculates a calibratable delay time with a mass flow dependency.

5. The internal combustion engine according to claim 2, wherein the heat loss is calculated as a sum of heat losses over exchange surfaces of the exhaust after treatment system, with ambient temperature.

6. The internal combustion engine according to claim 5, wherein the heat loss is calculated with a transfer coefficient that is dependent on vehicle speed.

7. The internal combustion engine according to claim 1, wherein the output of the response circuit part is an undelayed response that is low pass filtered with a mass flow dependent variable time constant.

8. The internal combustion engine according to claim 1, wherein the response circuit part is provided by a low pass filter and the adder, said adder adding a temperature of the exhaust to an output of a divider, the divider provided with a power term, to be divided by a mass flow of the exhaust multiplied by a specific heat value, dependent on the temperature of the exhaust; which low pass filter filters the output of the adder by a mass flow based time constant to provide an undelayed response.

9. The internal combustion engine according to claim 8, wherein the delay delayer circuit part comprises a variable delay provided with an input receiving the undelayed response, said variable delay further comprising an input receiving the mass flow based time constant, and an output providing a delayed response based on the mass flow based time constant that is dependent on the mass flow of the exhaust.

10. The internal combustion system according to claim 9, wherein the mass flow of the exhaust is low pass filtered.

11. The internal combustion system according to claim 1, wherein the controller is a PI controller and wherein a P-action is provided with the control error signal and a calibratable gain from a time-filtered mass flow value; and wherein an I-action is provided with the control error signal and the calibratable gain from the time-filtered mass flow value; wherein the P-action and I-action are combined into the feedback signal; and wherein a feed forward signal is provided in addition to the feedback signal to result in the adjusted heating power setpoint value.

12. The internal combustion engine according to claim 1, wherein the heater system is disposed in or near an exhaust line of the internal combustion engine, and wherein the heat is transported via the exhaust line to the after treatment system.

13. The internal combustion engine according to claim 1, wherein the heater system is disposed in or near the engine after treatment system.

14. The internal combustion engine according to claim 1, wherein the heater system is provided by thermal measures of operation of the combustion engine.

* * * * *